US005833557A

United States Patent [19]

Cole

[11] Patent Number: 5,833,557

[45] Date of Patent: Nov. 10, 1998

[54] TRAMPOLINE BASKETBALL GAME

[76] Inventor: Edward W. Cole, 6914 Rockingham Dr., SW, Cedar Rapids, Iowa 52404

[21] Appl. No.: 795,061

[22] Filed: Feb. 6, 1997

[51] Int. Cl.[6] ..... A63B 63/08

[52] U.S. Cl. ..... 473/472

[58] Field of Search ..... 473/472, 473, 473/476, 478, 479, 480, 481, 485, 447, 449, 433; 273/398, 401, 402

[56] References Cited

U.S. PATENT DOCUMENTS

| | | | |
|---|---|---|---|
| 2,889,149 | 6/1959 | Williams | 473/433 |
| 3,201,126 | 8/1965 | Nissen | 473/478 X |
| 3,365,196 | 1/1968 | Miller | 473/485 |
| 3,388,909 | 6/1968 | Woods | 473/472 |
| 3,603,588 | 9/1971 | Ebstein | 473/485 |
| 4,239,214 | 12/1980 | Brenner | 273/402 X |

*Primary Examiner*—William H. Grieb
*Attorney, Agent, or Firm*—Suiter & Associates PC

[57] ABSTRACT

A trampoline basketball game structure comprising an elevated horizontal rebound surface, two opposing and facing goals, and a resilient barrier separating the horizontal rebound surface into two playing areas is disclosed. Also disclosed is a game employing the structure.

1 Claim, 8 Drawing Sheets

TRAMPOLINE BASKETBALL GAME

BACKGROUND OF THE INVENTION

This invention relates to a trampoline device and games associated therewith, and more particularly to an apparatus comprising basketball hoop and backboard used in conjunction with playing areas comprising flexible rebound surfaces.

SUMMARY OF THE INVENTION

The basketball trampoline device according to the present invention comprises two facing goals located at opposite ends of an elevated rebound surface. The goals comprise an opening or aperture through which a player attempts to throw an inflated ball such as a basketball or the like. The goals preferably comprise standard basketball hoop and backboard assemblies, although other sizes may be employed, such as goals sized for use with miniature basketballs and the like.

The device according to the present invention also comprises substantially upright resilient surface spanning the area from the edge of the rebound surface up to the bottom of the goal, e.g., the bottom of the backboard assembly. The upright surfaces prevent a user from falling off the edge of the rebound surface and serves to keep the ball within the playing area. In a preferred embodiment, the vertical resilient surfaces are not perfectly upright, but are angled inward from the goal to the rebound surface, thereby forming an angle with the rebound surface of greater than 90 degrees, preferably from about 100 degrees to about 135 degrees. In this manner, this resilient surface prevents a player from impacting the goal and the wall also provides an additional rebound surface from which a player may propel himself or herself during play.

The horizontal rebound surface between the two goals is partitioned into two symmetrical playing areas by a central partition. Thus, in a game where two players are competing, i.e., one in each playing area, the central partition, or gantry, will serve to prevent collisions between the players. The central partition may comprise any padded or shock absorbing structure. The central partition preferably comprises two parallel substantially vertical resilient surfaces located on either side of and parallel to the midline bisecting the horizontal rebound surface and dividing the horizontal rebound surface into the two respective playing areas. The vertical resilient surfaces are most advantageously spaced a sufficient distance apart given the resiliency of the surfaces to prevent players on either side from colliding, or at least reducing the force and/or impact of any potential collision to a harmless or minimal amount.

The playing areas also preferably comprise side members to prevent players from falling from the horizontal rebound surface. The side restraints may be of the same material or of a different material as the central partitions and/or end partitions. However, depending on whether the particular device will be used for exhibitions, competitions, and the like, it may be desirable to employ a side restraining material which will allow spectator viewing, such as tempered glass, plexiglass, net material, and the like.

Another aspect according to the present invention involves a ball game which is played within the structure according to the present invention. With the central partition dividing the horizontal rebound surface into two playing areas, and with a player in each playing area, one player attempts to throw the ball from within his or her own playing area into the opposite goal located on the other player's side, and the other player attempts to defend the goal located on his or her side. When the ball reaches the other side, the players then reverse their offensive and defensive roles. Play may thus continue, e.g., for a fixed period of time, until one player scores a certain number of goals, etc.

These and other features, aspects, and advantages of the present invention will become better understood with regard to the following description, appended claims, and accompanying drawings.

DETAILED DESCRIPTION OF THE INVENTION

Figure 1:
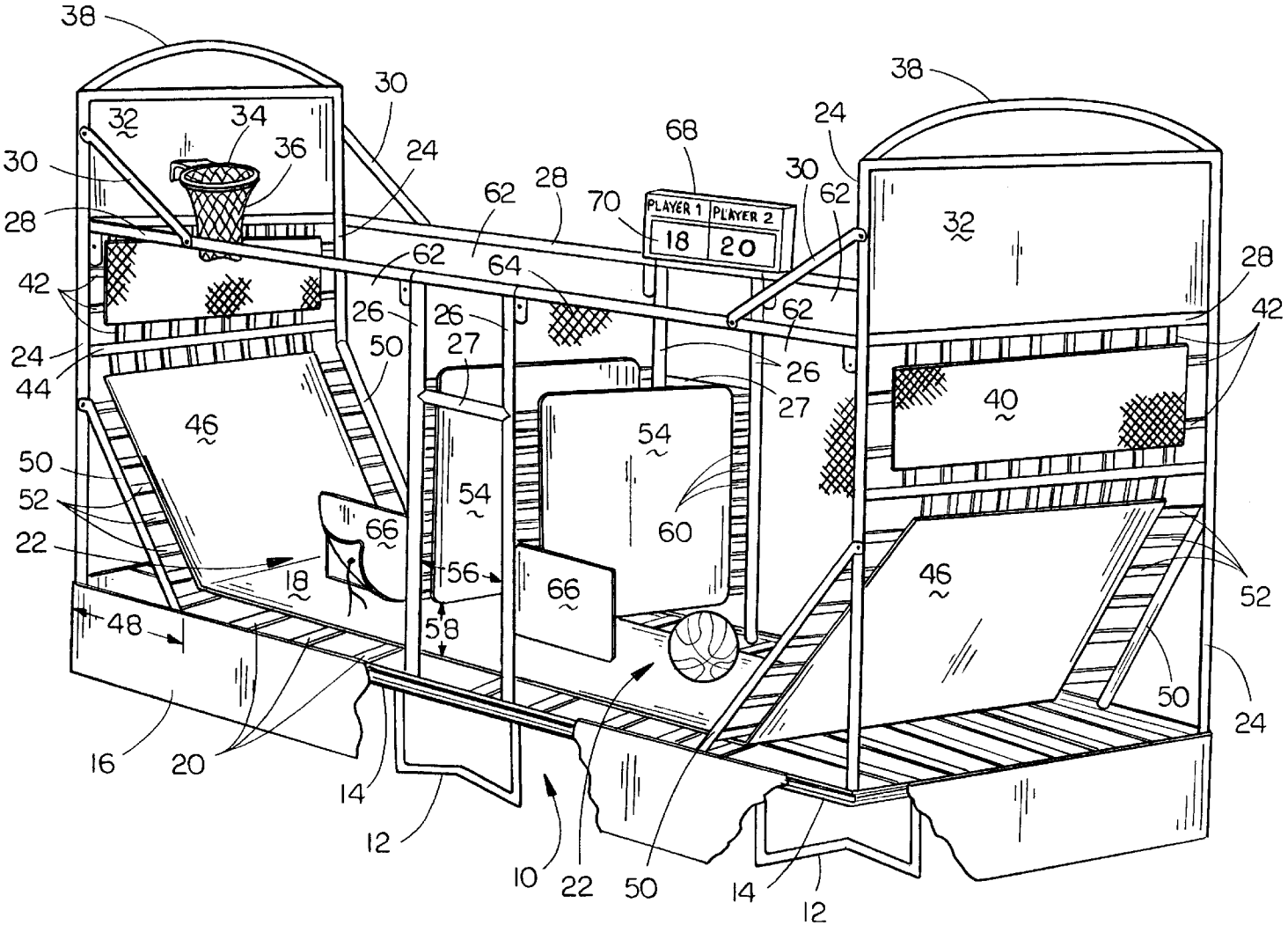
FIG. 1 is a perspective view of a preferred embodiment of the trampoline basketball device according to the present invention.
Figure 2:
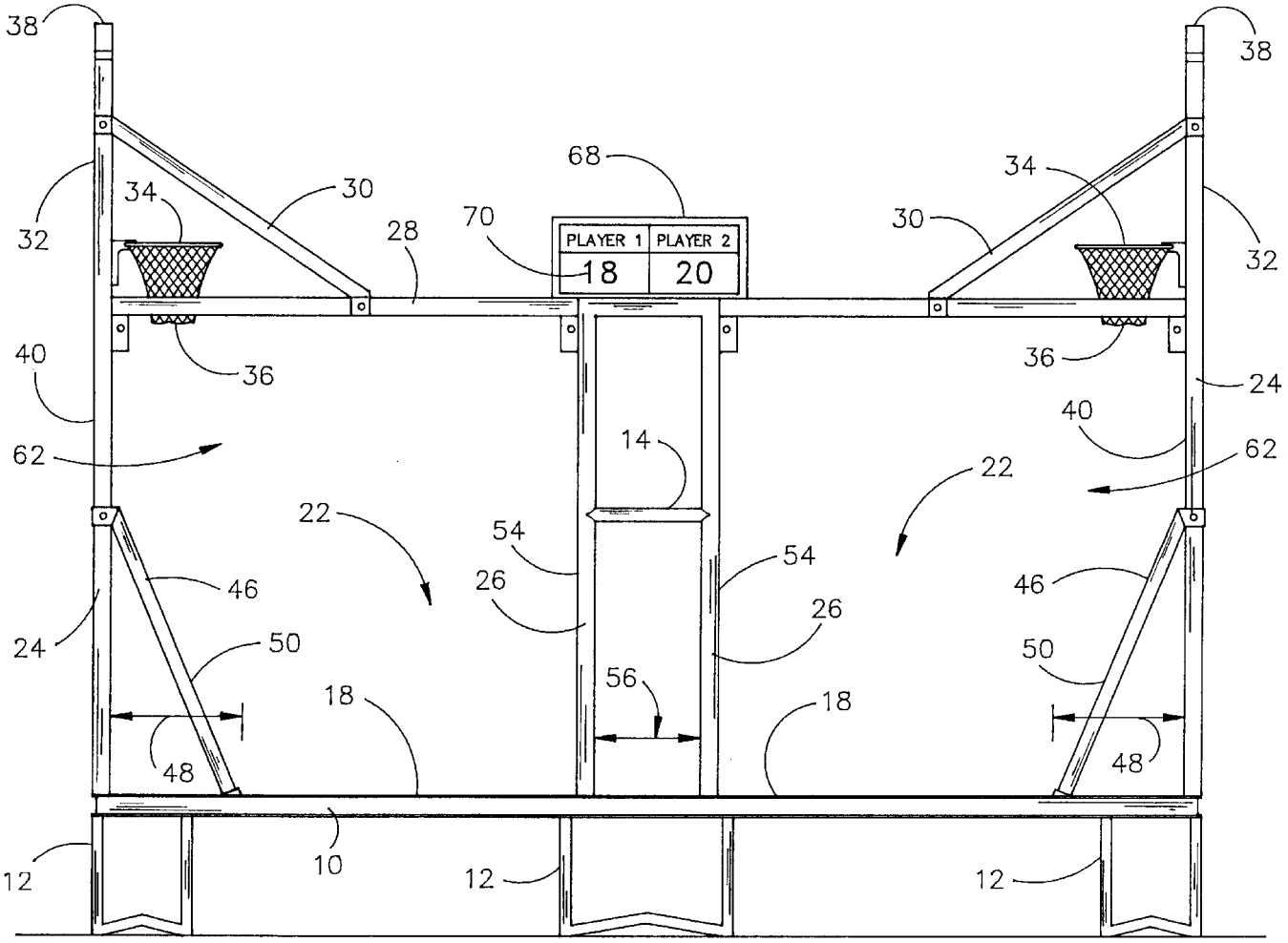
FIG. 2 is a side view of the embodiment shown in FIG. 1.

Referring first to FIGS. 1 and 2, a first preferred embodiment according to the present invention is shown to comprise a base frame assembly 10 elevated by legs 12 and supporting horizontal rebound surface 18. Optional skirt 16 (FIG. 1), shown in partial cutaway view, may be employed to hide base frame assembly 10 and legs 12 from view, and may also contain other decorational or informational indicia, and the like, thereon.

Frame 10 supports rebound surface 18. Rebound surface 18 may comprise any flexible material which may be used in constructing a trampoline, such as canvas, nylon, and the like, and the surfaces may comprise a sheet of such material, or may comprise a web woven of strips of such material. Rebound surface 18 is attached to frame 10 by means of springs 20 (FIG. 1). Springs 20 may be of any type suitable for trampoline construction. For example, springs 20 may comprise a plurality of strips of elastic material securely sewn or otherwise attached around the periphery of surfaces 18 forming loops through which frame 10 may be inserted. Alternatively, springs 20 may comprise coiled, e.g., metal, springs with hooks or loops (not shown) which may engage loops or hooks (not shown) on frame 10 and complimentary loops, hooks, or grommets (not shown) on surface 18. Additionally, the number of springs may be changed, or springs of different spring constants may be utilized, to provide a desired rebound factor or to accommodate players (not shown) of various sizes. Thus, the tension may be increased, for example, when larger persons or adults are playing, and may be decreased when smaller children are playing.

Rebound surface 18 may comprise separate, or otherwise mechanically isolated, surfaces in each of playing areas 22, however, surface 18 preferably comprises a single continuous surface spanning the two playing areas 22 whereby the impact of each of the players on the rebound surface will affect the other. In this manner, the additional strategic element of "kipping" is added to the game, i.e., where a player uses the timing of his or her own jump to change the rebound characteristics of surface 18. For example, a player can cause the other player to be rebounded higher than intended by impacting surface 18 just as the other player is being rebounded; conversely, a player can deaden the rebound surface 18 when impact is timed to occur nearly simultaneously.

Extending vertically from the trampoline frame 10 are four corner posts 24 and four gantry posts 26. A rectangular top frame assembly 28 is attached to the top of the four corner posts 24 and four gantry posts 26. Corner posts 24 and top frame assembly 28 are adjoined by support braces 30. Gantry posts 26 may also be further supported by braces 14.

Mounted between each pair of corner posts 24 is a basketball goal assembly comprising backboard 32, rim 34, and net 36. Backboard 32 is depicted as traversing the entire width of the playing area 22. Each of backboards 32 may further have a bowed member 38 mounted thereon. Bowed member 38, as well as upper support braces 30 are helpful in keeping the ball within the playing areas 22 by deflecting errant shots or shots bouncing off the rim, etc.

Directly beneath backboard 32 is a net assembly 40 substantially in the same plane as backboard 32. Net 40 serves as a stop and may comprise any netted material or alternatively, may comprise the same material as horizontal rebound surface 18. Net 40 is attached to corner posts 24, top frame 28 and crossbar 44 (FIG. 1) mounted between each pair of corner posts 24 by attachment members 42 (FIG. 1). Attachment members 42 may comprise springs such as springs 22 employed for the horizontal rebound surface 18, or alternatively may comprise other means such as a hook or tie used to engage complimentary hooks, loops, grommets, etc. (not shown) on net 40 and posts 24, frame 28, and crossbar 44.

Directly beneath net 40 is backstop 46. Backstop 46 is preferably mounted at an angle as depicted in FIG. 1, and advantageously is mounted by springs 52 (FIG. 2) to crossbar 44 and to a pair of lower support braces 50. The angle of braces 50 and thus backstop 46 is such that backstop 46 meets horizontal rebound surface 18 at a distance 48 from corner posts 24 toward the center of horizontal rebound surface 18. Preferably, the angle of backstop 46 is such that distance 48 is about equal to or greater than the diameter of rim 34, thereby preventing a person from landing directly beneath rim 34 and thus preventing a player from rebounding upward into rim 34 and potentially sustaining an injury. A player heading toward the area directly beneath rim 34 will be rebounded by backstop 46 back toward the middle of playing area 22. In this manner, backstop 46 likewise helps prevent goal tending. Backstop 46 preferably comprises the same material as horizontal rebound surface 18 and is securely flush therewith. Backstop 46 may also be securely attached to or adjoined with horizontal rebound surface 18, e.g., with snaps, ties, or other securing means, or horizontal rebound surface 18 and backstops 46 may be formed of a single continuous sheet or web of material therewith.

Gantry posts 26 engage vertical resilient gantry barriers 54 separating playing areas 22. The gantry barriers 54 are preferably the same material as employed for the horizontal rebound surface 18. In an alternative embodiment (not shown) the pair of gantry barriers 54 can be replaced with a single cushioning or padded barrier. Each gantry barrier 54 is resiliently mounted between each pair of gantry posts 26 using springs 60 (FIG. 1). Gantry barriers 54 are located at a distance 56 from each other that is sufficient to prevent the players from colliding. Distance 56 is preferably about two feet. In an especially preferred embodiment, gantry barriers 54 are elevated from the horizontal rebound surface 18 a distance 58 (FIG. 1) sufficient to let the ball pass underneath. This feature adds yet another strategic element to the game in that a player may have multiple consecutive offensive opportunities if the opposing player does not, in addition to defending his or her goal, successfully prevent the ball from returning beneath gantry barriers 54 to the player making the shot. Also, the angle of backstop 46 can cause the ball to tend to be rebounded toward the gantry barriers 54. When distance 58 is fairly close to the diameter of the ball, the strategy of kipping as described above (i.e., the use and timing of a player's impact to change the rebound characteristics of horizontal rebound surface 18) may also be used to prevent the ball from crossing beneath the gantry barriers 54. For example, a player can time and position his or her impact as to momentarily make distance 58 smaller and/or to cause a rolling ball to be rebound upward, thus blocking passage of the ball beneath gantry barriers 54.

Each of the two playing areas 22 are bounded on each side by two side areas 62. Each of side areas 62 comprise the planar area bounded by top frame 28, gantry posts 26, trampoline frame 10, lower support brace 50, and corner posts 24. In an embodiment not shown, side areas may be enclosed using the same material as used for horizontal rebound surface 18 and/or backstops 46. However, when it is desirable to use the game device according to the present invention for spectator purposes, the material is preferably one that permits transvisualization of the action within playing areas 22. The material may be tempered glass, plexiglass, Mylar sheets, and the like (not shown) or any other material that is of sufficient strength to prevent a player from falling from or being rebounded from the playing area 22. Where a hard or rigid material such as glass is used, it is preferably mounted via a sufficiently resilient means (not shown) as to prevent injury when impacted by a player. The degree of resiliency desired will depend on the degree of impact protection to be worn during play, for example head protection such as helmets and the like, and other padding such as knee and elbow pads and the like. In the depiction of FIG. 1, side areas 62 are shown with a netting material 64 shown in FIG. 1 in partial cutaway relief. Side areas 62 also preferably comprise access flaps 66 permitting entry into the playing areas 22. Access flaps may be secured via ties, snaps, zippers, and the like.

The game device according to the present invention is depicted with a scoreboard 68 centrally located as to be visible to players as well as spectators. Scoreboard 68 is preferably controlled electronically. For example, the scoreboard may be coupled electronically a sensor or switch (not shown) which can detect the successful passage of the ball through rim 34. The scores may thus be communicated to scoreboard 68 for processing and display. In an embodiment not shown, scoreboard 68 may further comprise a clock or timer (not shown). The clock or timer may be electronically coupled with scoreboard 68 so that, for example, when play is confined to a limited time period, scores registering after the expiration of the time period will not be added to a players score. The scoreboard can additionally be programmed to display statistics or other information. For example, scoreboard 68 could be programmed to sense other data, such as the ball crossing the midline between playing areas 22, or accept user input for calculation of statistics such as number of shots taken, percentage of successful shots, and the like. Where play is divided into multiple timed periods such as halves, quarters, etc., the scoreboard 68 can be used to display a breakdown of the score or other statistics by timed period. Score indicia 70 may be a series of lights, LEDs, etc., or may comprise a LCD display panel, and the like.

In an embodiment not shown, springs 20, 52, and/or 42 are covered, e.g., with a padded material, to prevent injury resulting from a player's limbs entering spaces formed between the spring members. Likewise padding (not shown) may be employed to cover portions frame elements which may be exposed to a player from within playing area 22, such as base frame 10, corner posts 24, gantry posts 26, top frame 28, upper support braces 30, lower support braces 50, crossbar 44, and the like.

Figure 3:
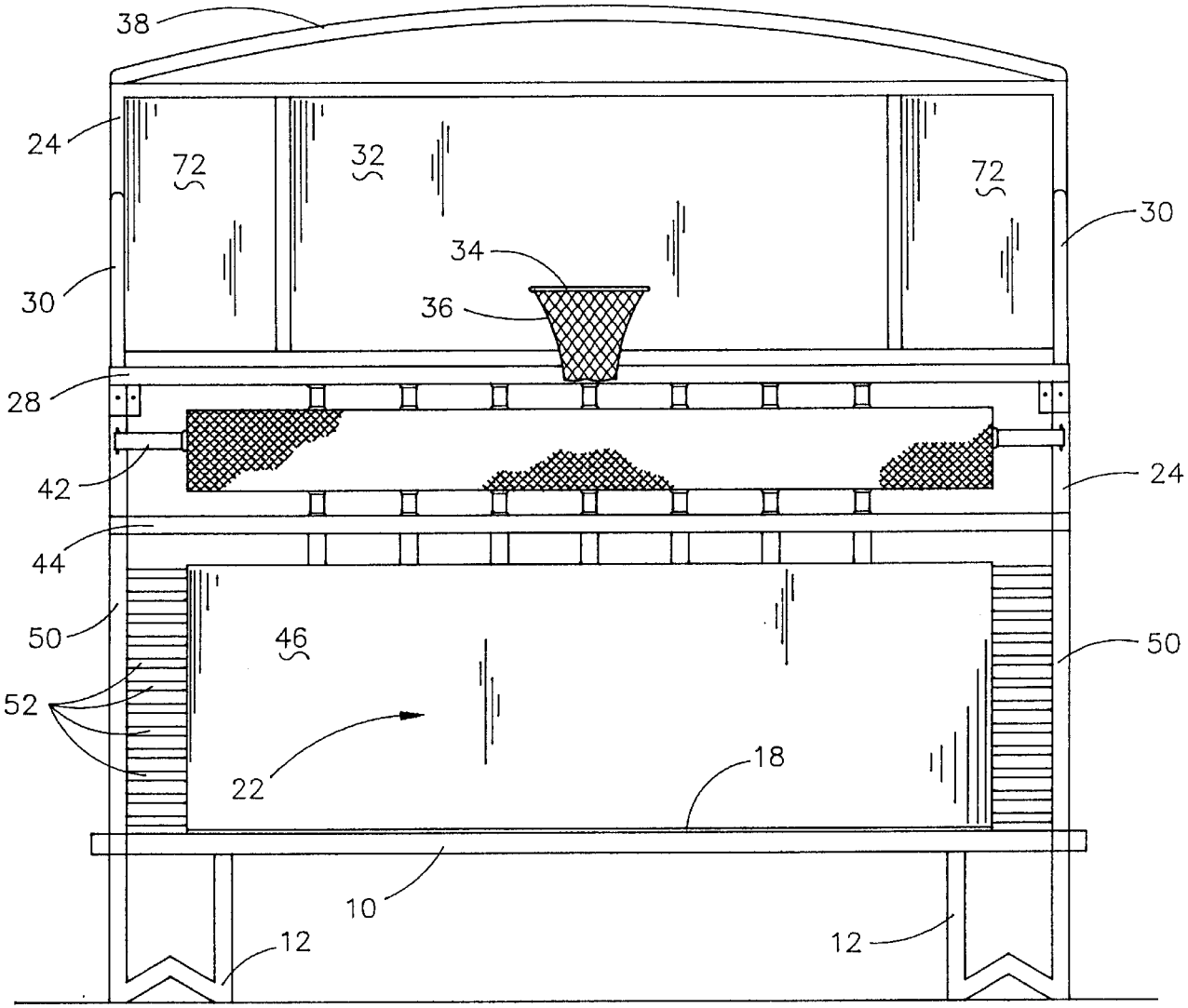
FIG. 3 is an end view of a second preferred embodiment according to the present invention.

FIG. 3 shows an end view of an embodiment according to the present invention which is a modified version of the embodiment shown in FIGS. 1 and 2. FIG. 3 shows an embodiment wherein backboard 32 is located between two side panels 72. Panels 72 may be made of a rigid material, such as the same material from which the backboard is made, or may comprise a net or resilient material. Panels 72 may are depicted as being mounted in the same plane as backboard 32, and therefore serve to extend the width of the playing area 22 and acting as a stop to keep the ball within playing area 22. In FIG. 3, base frame 10, horizontal rebound surface 18, top frame assembly 28, bowed members 38, net 40, crossbar 44, gantry barriers (see FIG. 1, reference numeral 54), are all accordingly wider as compared to the embodiment depicted in FIG. 1 to accommodate the extension of the court width due to the presence of panels 72.

Figure 4:
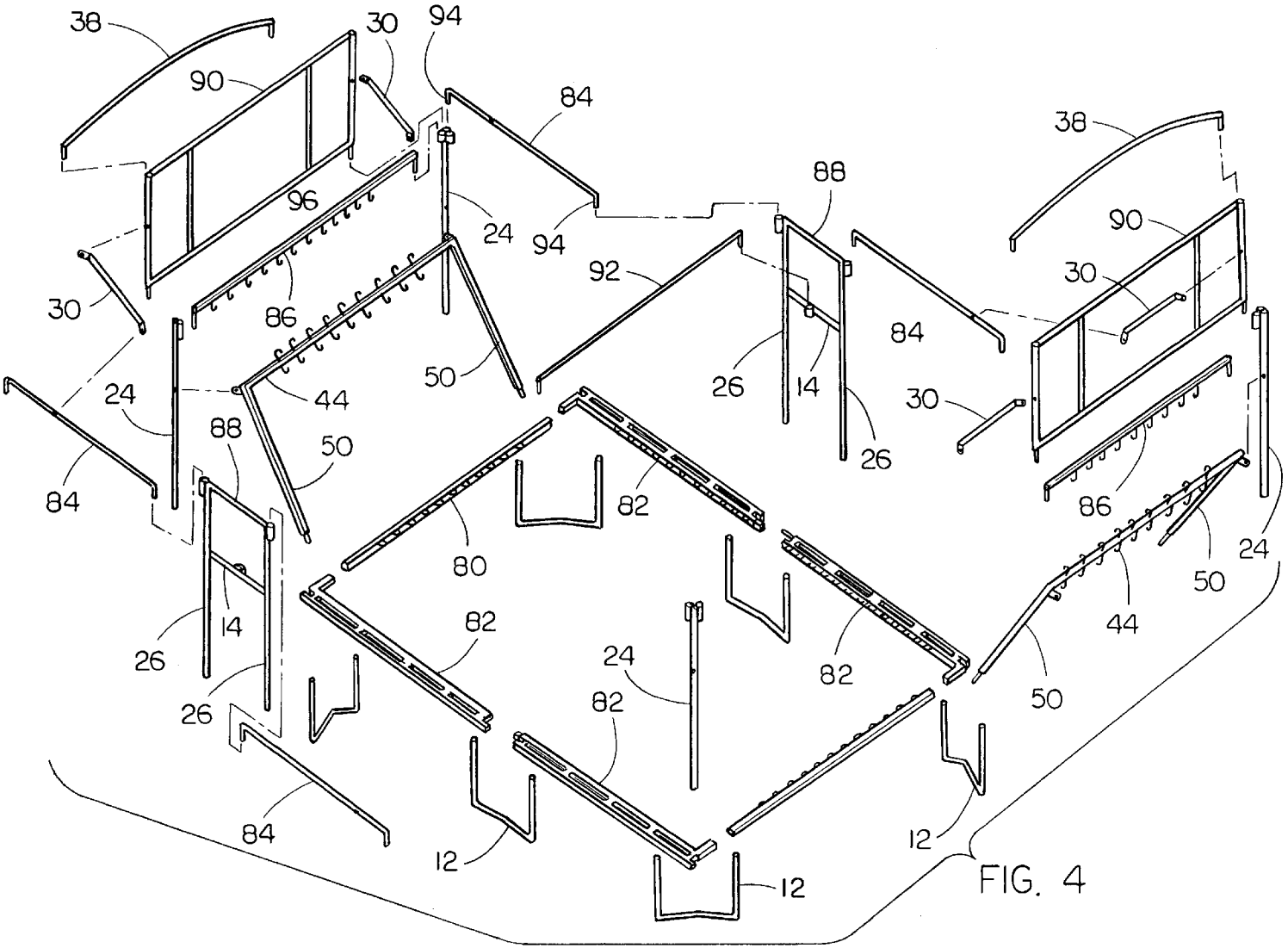
FIG. 4 is an exploded view of the frame assembly of the embodiment depicted in FIG. 1.

FIG. 4 shows an exploded view of a preferred frame assembly according to the present invention. Base frame assembly 10 (see FIG. 1) comprises two end members 80 and four interlocking side members 82. Base frame assembly 10 (FIG. 1) is elevated via legs 12 to a sufficient height to permit depression of the horizontal rebound surface 18 (FIG. 1) upon impact of a player without contacting the ground or floor below.

Vertical corner posts 24 and gantry posts 26 support top frame assembly 28 (FIG. 1) which comprises top frame side members 82, end top frame members 86, and upper gantry support members 88. Gantry posts 26 are supported by lower gantry support braces 14 and gantry cross member 92. Lower support braces 50 and crossbar 44 which support backstop 46 (FIG. 1) is depicted as a single piece which securely engage side members 52 and corner posts 26. Goal frame 90 engages corner posts 24 and upper braces 30 secure goal frame 90 to top frame side members 84. Bowed member 38 engages the top of frame 90.

Figure 5:
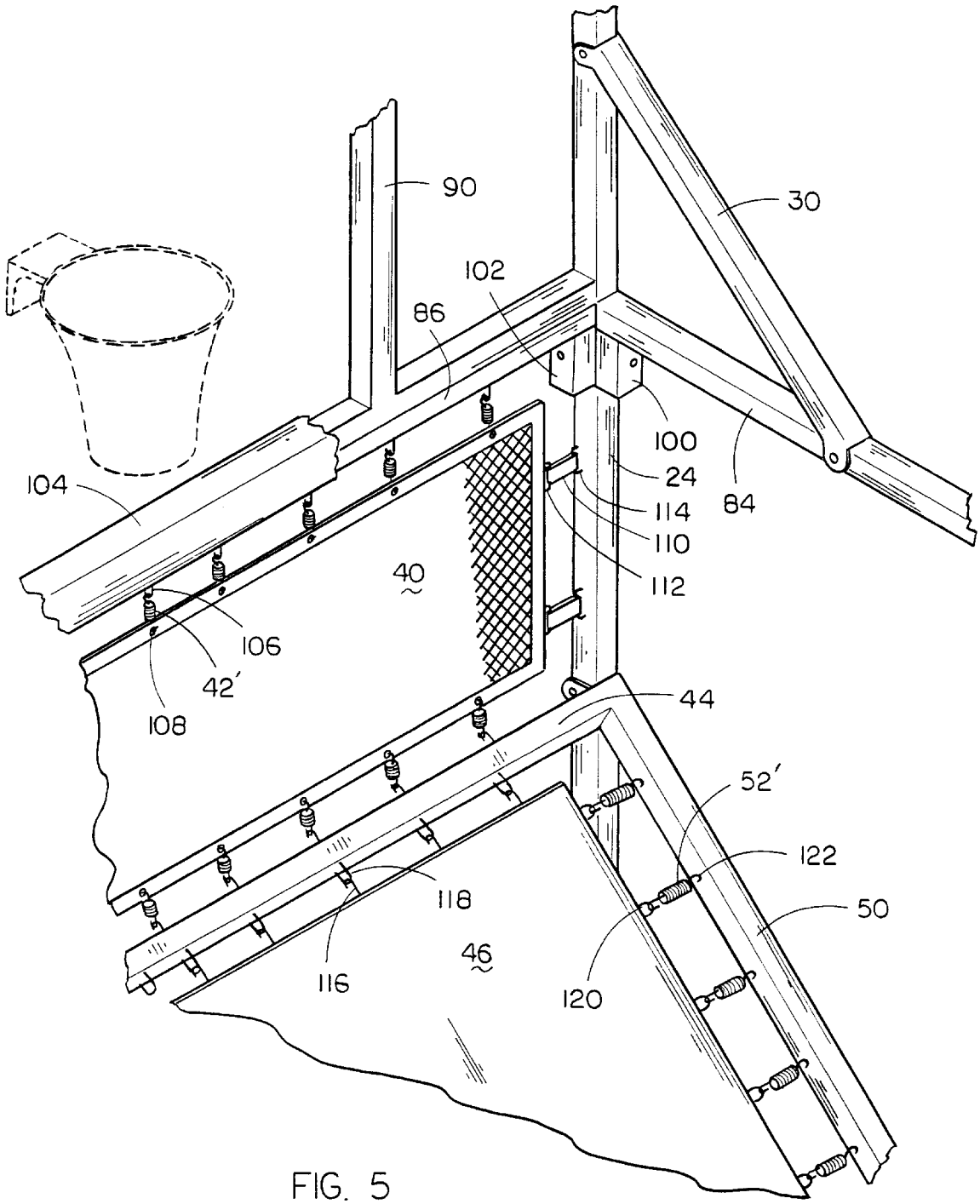
FIG. 5 is a partial isometric view of a corner of the device according to the present invention enlarged to show a preferred means of attachment of the rebound surfaces to the frame assembly.

FIG. 5 shows an enlarged corner of the device according to the present invention depicting some exemplary means for securing the various frame members together and for securing net 40 and backstop 46 to the frame members.

Post 94 (FIG. 4) of top side frame member 84 engages and is secured within anchoring unit 100 on corner post 24. Similarly, top end frame member 86 engages anchoring unit 102 on corner post 24. Goal frame 90 engages corner post 24 via post 96 (FIG. 4) and upper brace 30 secures frame 90 thereto. A padded surface 104 is shown on frame 90 in partial cutaway view. Net 40 is secured by springs 42' abridging frame hooks 106 and net grommets 108. Net 40 is secured on its sides by ties 110 engaging loops 112 on net 40 and frame loops 114. Ties may engage any type of rope, chain, tie, strips comprising hook and loop fasteners, nylon cable ties or zip ties, and the like. Backstop 46 is attached to crossbar 44 via hooks 116 and loops 118. Backstop 46 is attached to support brace 50 via springs 52' engaging loops 120 and frame loops 122.

Figure 6:
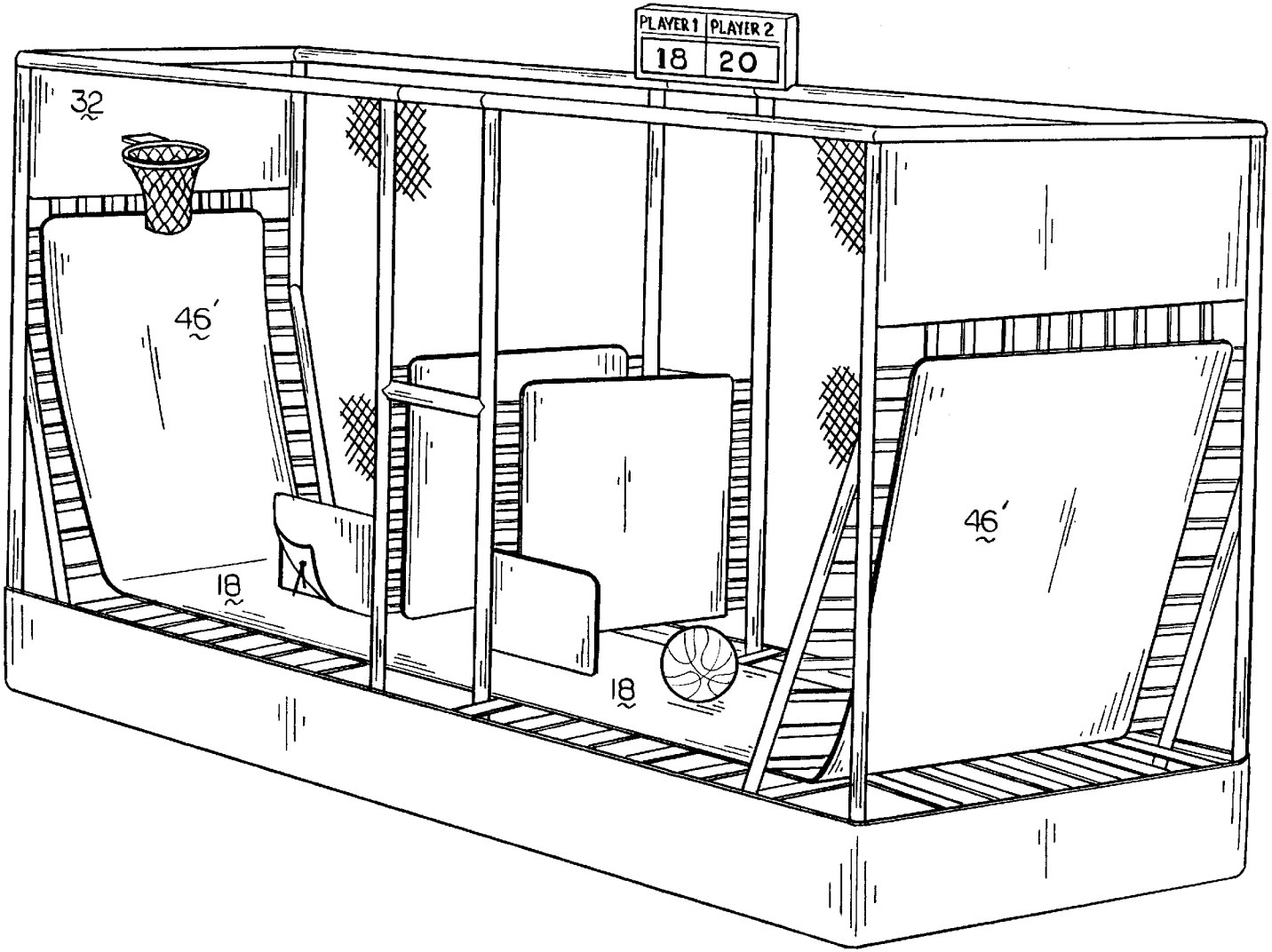
FIG. 6 is a perspective view of a second preferred embodiment according to the present invention.

FIG. 6 depicts yet another preferred embodiment wherein net 40 (FIG.1) and crossbar 44 are not present, and where backstop 46' extends from horizontal rebound surface 18 to backboard 32. In this manner, backstops 46' and horizontal rebound surface 18 may comprise a single contiguous surface.

Figure 7:
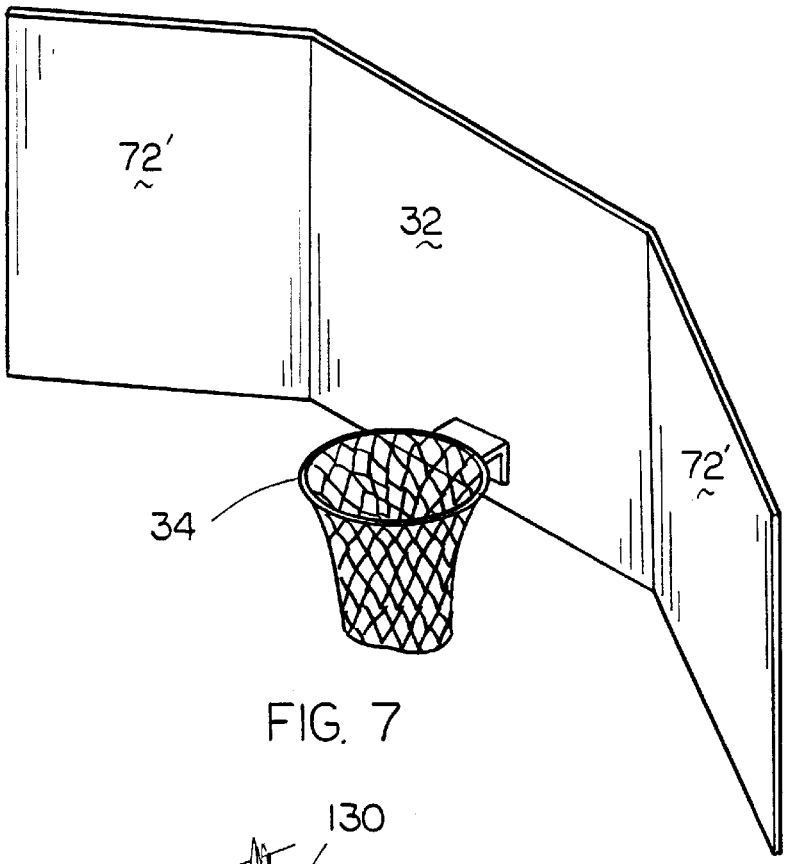
FIG. 7 depicts a backboard having angled adjacent side panels.

FIG. 7 depicts a modification of the goal area wherein side panels 72' are angled inward. As such panels 72' serve not only to extend the width of the playing area and provide a stop to keep the ball within the playing area, but also add an additional strategic element by providing an additional target off from which a shot may be banked into the basket.

Figure 8:
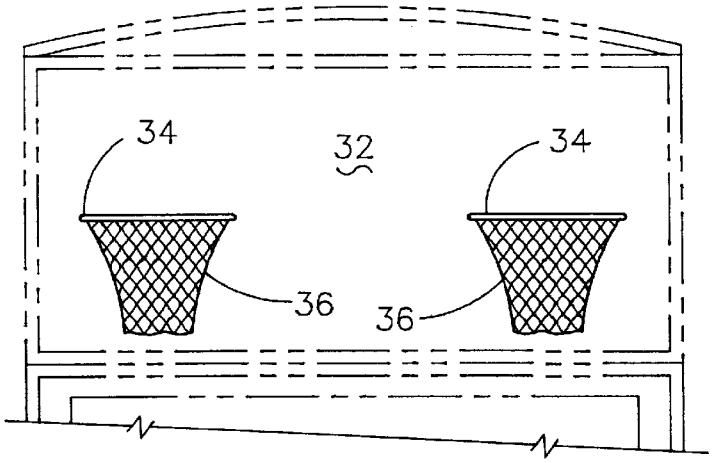
FIGS. 8–10 show various configurations of an embodiment according to the present invention wherein a plurality of goals are employed.
Figure 9:
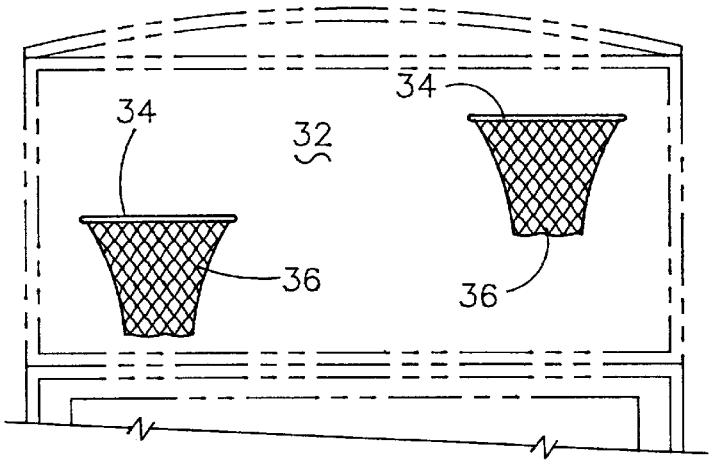
Figure 10:
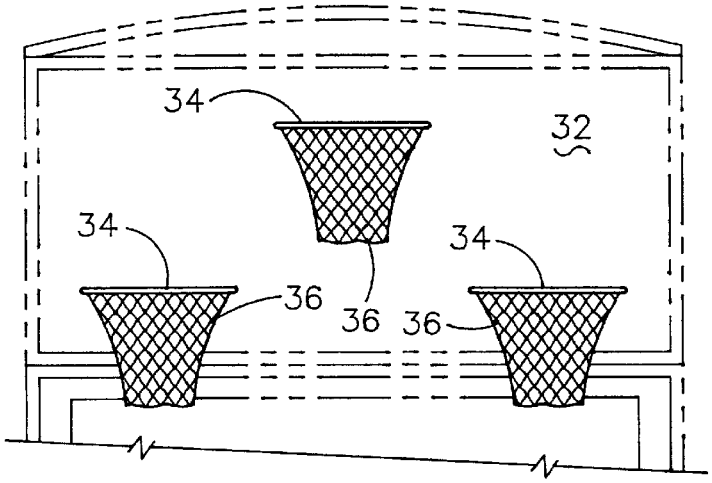

FIGS. 8–10 depict backboards 32 having a plurality of rims 34 and nets 36 mounted thereon. The use of plural goals adds a strategic element since a defender must defend two goals simultaneously. This strategic element is further enhanced when different goals are assigned different scoring values. When used in conjunction with an automatic scoring system (not shown), the values assigned may be selectable by the users.

Figure 11:
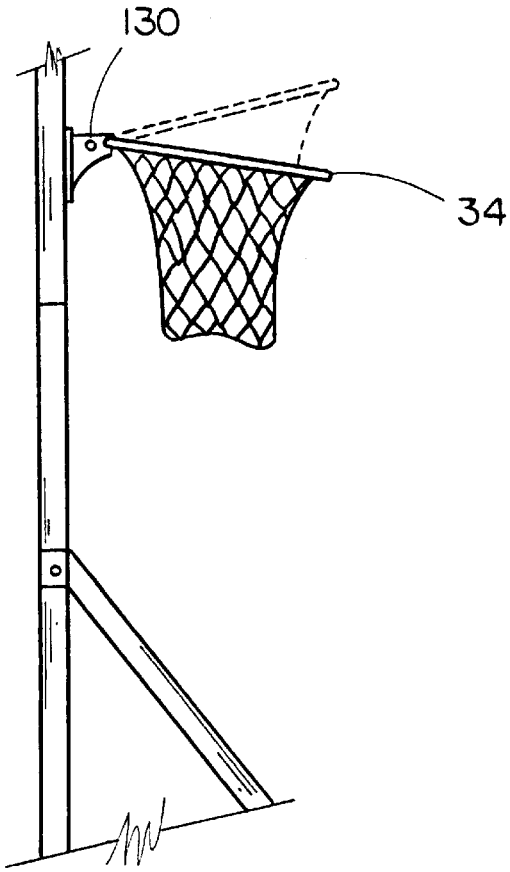
FIG. 11 depicts an embodiment according to the present invention wherein the rim may be tilted upward or downward.

FIG. 11 shows another preferred embodiment according to the present invention wherein the rim 34 may be angled upward or downward by rotating about hinge 130, thereby increasing or decreasing the difficulty of scoring a goal. In this manner the game can be made easier for very young players, beginners, and the like, and can be made more difficult for experienced or skilled players. By differentially adjusting the goals, this feature enables one to employ a handicapping system, as for example, when a skilled player is competing against a relatively unskilled player.

The description above should not be construed as limiting the scope of the invention, but as merely providing illustrations to some of the presently preferred embodiments of this invention. In light of the above description and examples, various other modifications and variations will now become apparent to those skilled in the art without departing from the spirit and scope of the present invention as defined by the appended claims. Accordingly, the scope of the invention should be determined solely by the appended claims and their legal equivalents.

What is claimed is:

1. A game apparatus comprising a frame forming two symmetrical and adjacent playing areas, wherein each of said playing areas comprises:

an elevated, substantially horizontal rebound surface springably retained on said frame, an inner substantially vertical resilient surface and an outer substantially vertical resilient surface, and a basketball goal mounted above said outer resilient surface;

whereby said playing areas are arranged such that said basketball goals are distally facing and said inner resilient surfaces form a space between said playing areas.

* * * * *